US006880530B2

(12) United States Patent
Oyama et al.

(10) Patent No.: US 6,880,530 B2
(45) Date of Patent: Apr. 19, 2005

(54) FUEL SUPPLY SYSTEM

(75) Inventors: Katsuya Oyama, Hitachinaka (JP); Shoji Sasaki, Hitachinaka (JP)

(73) Assignee: Hitachi, Ltd., Tokyo (JP)

( * ) Notice: Subject to any disclaimer, the term of this patent is extended or adjusted under 35 U.S.C. 154(b) by 0 days.

(21) Appl. No.: 10/678,642

(22) Filed: Oct. 6, 2003

(65) Prior Publication Data

US 2004/0118384 A1 Jun. 24, 2004

(30) Foreign Application Priority Data

Oct. 7, 2002 (JP) ..... 2002-293155

(51) Int. Cl.[7] ..... F02M 51/00
(52) U.S. Cl. ..... 123/479; 123/490
(58) Field of Search ..... 123/479, 490; 251/129.1; 239/585.1; 361/154; 73/119 A, 118.1

(56) References Cited

U.S. PATENT DOCUMENTS

| | | | | | |
|---|---|---|---|---|---|
| 4,922,878 | A | * | 5/1990 | Shinogle et al. | 123/490 |
| 5,941,216 | A | * | 8/1999 | Arakawa | 123/490 |
| 6,173,700 | B1 | * | 1/2001 | Yamashita et al. | 123/490 |
| 6,234,150 | B1 | * | 5/2001 | Watanabe | 123/490 |
| 6,332,455 | B1 | * | 12/2001 | Sumida et al. | 123/490 |
| 6,431,155 | B1 | * | 8/2002 | Yamakado et al. | 123/490 |
| 6,453,876 | B1 | * | 9/2002 | Fukutomi et al. | 123/490 |
| 6,532,940 | B1 | * | 3/2003 | Ono et al. | 123/490 |
| 6,571,773 | B1 | * | 6/2003 | Yamakado et al. | 123/490 |
| 6,684,862 | B1 | * | 2/2004 | Oyama et al. | 123/490 |
| 6,712,048 | B1 | * | 3/2004 | Aoki et al. | 123/490 |

FOREIGN PATENT DOCUMENTS

| | | | | |
|---|---|---|---|---|
| DE | 10015647 A1 | | 10/2001 | |
| EP | 0309753 A1 | | 4/1989 | |
| EP | 1408221 | * | 4/2004 | F02D/41/22 |
| JP | H11-13519 | | 1/1999 | |
| JP | H11-82127 | | 3/1999 | |
| JP | 2002061534 A | | 2/2002 | |
| JP | 124890 | * | 4/2004 | F02D/41/22 |

OTHER PUBLICATIONS

European Search Report mailed Feb. 6, 2004.

* cited by examiner

*Primary Examiner*—Hai Huynh
(74) *Attorney, Agent, or Firm*—Crowell & Moring LLP

(57) ABSTRACT

A fuel supply system detects the detects operating condition of an engine, calculates the width of the fuel injection pulse including valve-opening signal and holding signal based on the detected operating condition, and supplies valve-opening current to the solenoid located in the fuel injector based on the fuel injection pulse width and a holding current for holding the valve-opening condition after the valve-opening current has reached the predetermined current value. Current is supplied to the solenoid when the logical product of the valve-opening signal and the holding signal has been formed. The fuel supply system diagnoses an abnormality of the fuel injector when the time period from the start of the fuel injection pulse until the valve-opening current reaches the predetermined current value is shorter than the predetermined one.

18 Claims, 15 Drawing Sheets

FUEL SUPPLY SYSTEM

BACKGROUND OF THE INVENTION

The present invention relates to a fuel supply system.

The Japanese Laid-Open Patent Publication No. Hei 11-13519 has disclosed a diagnostic device for a driving device of a solenoid-type fuel injector (hereafter, referred to as injector) used in an engine. The diagnostic device is capable of diagnosing the presence of a failure related to valve-opening current in a fuel injector drive control device.

Although the publication mentions that diagnostic device is capable of detecting the presence of a failure in the fuel supply system, it does not state that the device is able to protect the fuel supply system itself. Therefore, if a failure occurs in the mode in which over-current runs through the fuel supply system, there is a possibility that the fuel supply system may be damaged.

SUMMARY OF THE INVENTION

An object of the present invention is to provide a fuel supply system that can diagnose the fuel supply system itself as well as protect the fuel supply system itself. Reliability of diagnosis is also improved by providing a means to determine each failure mode.

To achieve the above objective, the present invention provides a fuel supply system comprising means for detecting operating condition of an engine, means for calculating, based on the detected operating condition, the width of the fuel injection pulse comprising two signals: valve-opening signal and holding signal, means for supplying valve-opening current to a solenoid located in the fuel injector based on the width of the fuel injection pulse, and means for supplying the solenoid holding current which maintains the valve-opening state after the valve-opening current has reached a predetermined current value; and the fuel supply system supplying current to the solenoid when the logical product of the valve-opening signal and the holding signal has been formed; and the fuel supply system diagnosing abnormal condition of the fuel injector when the time period from the start of the fuel injection pulse until the valve-opening current reaches the predetermined current value is shorter than the predetermined time.

According to the above mechanism, if the fuel supply system malfunctions when over-current runs through the system, the fuel supply system can protect itself.

DETAILED DESCRIPTION OF THE PREFERRED EMBODIMENTS

Now, explanation will be given about embodiments. It is possible to increase reliability of diagnosis by providing a means which can determine each failure mode.

Figure 1:
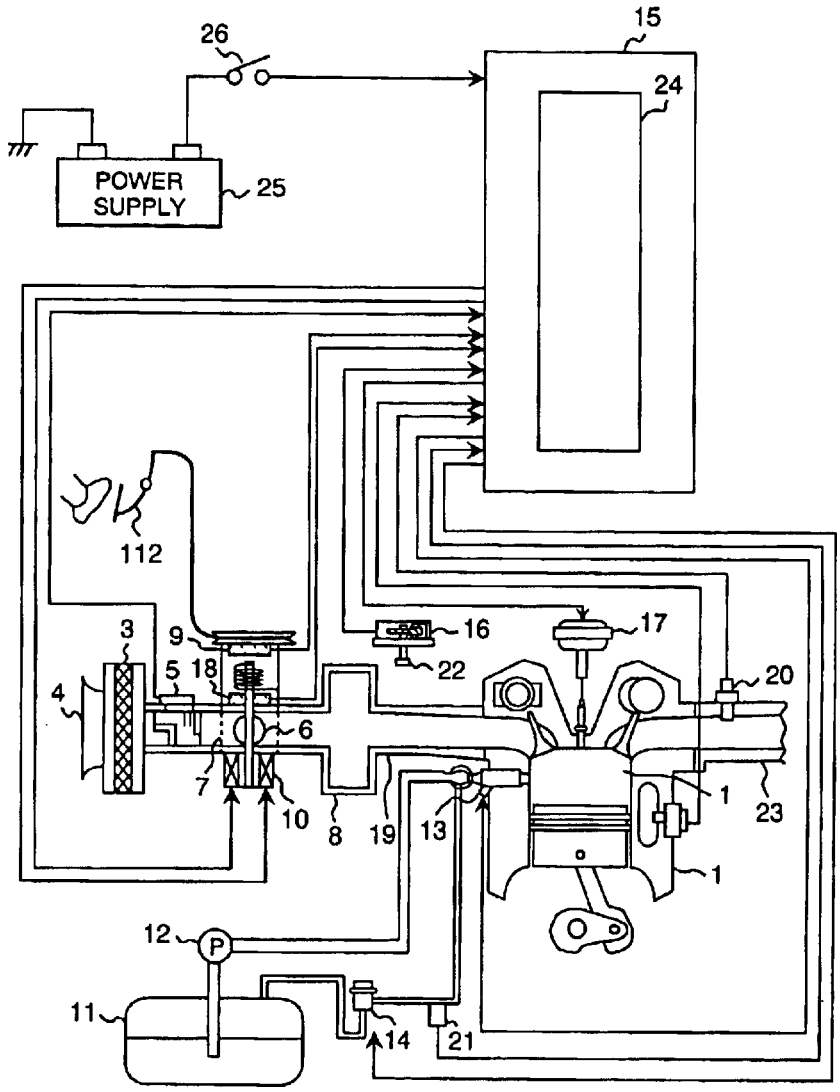
FIG. 1 is a schematic diagram of a system.

FIG. 1 shows an engine system according to an embodiment. Air entering an engine 1 from the input section 4 of an air cleaner 3 first passes through a throttle valve device 7 that has a throttle valve 6 to control the amount of air intake and then enters a collector 8. The throttle valve 6 is connected to a motor 10, and driving the motor 10 operates the throttle valve 6. The amount of air intake is regulated by the operation of the throttle valve 6. In the collector 8, intake air is distributed into each air intake pipe 19 and supplied to each cylinder 2 of the engine 1.

On the other hand, fuel (mainly gasoline) is pumped from a fuel tank 11 by a fuel pump 12, pressurized and regulated to a predetermined pressure by a fuel injector (injector) 13 and a variable fuel pressure regulator 14, and then injected into each cylinder 2 through an injector 13 that has a fuel injection port for each cylinder 2. The variable fuel pressure regulator 14 is controlled by an engine control unit (hereafter, referred to as ECU) 15. An air flow meter 5 outputs a signal indicating the amount of intake air and the signal is inputted into the ECU 15.

The throttle valve device 7 has a throttle sensor 18 for detecting the opening degree of the throttle valve 6 and the output data is also inputted into the ECU 15.

A crank angle sensor 16 is rotationally driven by a cam shaft 22 and outputs a signal indicating the rotation position of the crank shaft. This signal is also inputted into the ECU 15. An A/F (air/fuel ratio) sensor 20 located in an exhaust duct 23 detects an actual operation air/fuel ratio from exhaust gas components and sends the signal to the ECU 15.

An accelerator sensor 9 which is incorporated into the throttle valve device 7 is interlocked with an accelerator pedal 112 and detects the amount of accelerator pedal 112 operation performed by the driver and sends the signal to the ECU 15. The ECU 15 comprising a processing means (CPU) 24 receives various signals, such as the above-mentioned crank angle signal, accelerator opening degree signal and so on, sent by sensors that detect the engine's operating conditions. The ECU 15 then performs predetermined arithmetical operations and outputs predetermined control signals to the motor 10 to operate the above-mentioned injector 13, ignition coil 17 and the throttle valve, thereby controlling fuel supply, ignition timing, and intake air. An ignition switch 26 is disposed between the power supply (battery) 25 and the ECU 15. A fuel pressure sensor 21 is adjacent to a variable fuel pressure regulator 14 located in the fuel system and outputs the signal to the ECU 15.

Next, configuration of the control circuit of the injector 13 located in the ECU 15, shown in FIG. 2, will be described.

The control circuit 31 of the injector 13 consists of a circuit group as shown below. Now, the circuit group will be enumerated. First, there is a booster circuit 32 that generates, from battery voltage 26*a*, a voltage that is larger than the battery voltage. For the injector 13 to inject fuel into the cylinder 2, the pushing force of the spring that clamps a plunger located inside the injector 13 as well as internal fuel pressure is significantly high. Accordingly, large magnetomotive force is required for opening the valve of the injector 13, and electric current supplied from an ordinary battery voltage is not large enough to open the valve of the injector 13. Therefore, the above-mentioned booster circuit 32 is required.

Next, there is a switch element 33 for controlling the supply and shutdown of current provided from a boosted voltage generated by the above booster circuit 32 to the injector 13. There is also a switch element 34 for controlling the supply and shutdown of current provided from the battery voltage 26*a* to the injector 13. In the signal line 35*a* where electric current supplied from the switch elements 33 and 34 is wired OR, the voltage relationship is: boosted voltage 32*a*>battery voltage 26*a*. This means there is a possibility that the boosted voltage 32*a* may flow into the battery 26*a* via the switch elements 33 and 34. Accordingly, a back-current prevention element 35 is disposed between the signal line 35*a* and the switch element 34.

Switch elements 36 and 37 for sinking electric current flowing through the injector 13 toward the ground are disposed for each injector. There is also a reflux element 38. Electric current flowing from the injector 13 through the switch element 36 (or 37) to the ground is returned to the injector 13 via the reflux element 38.

Figure 2:
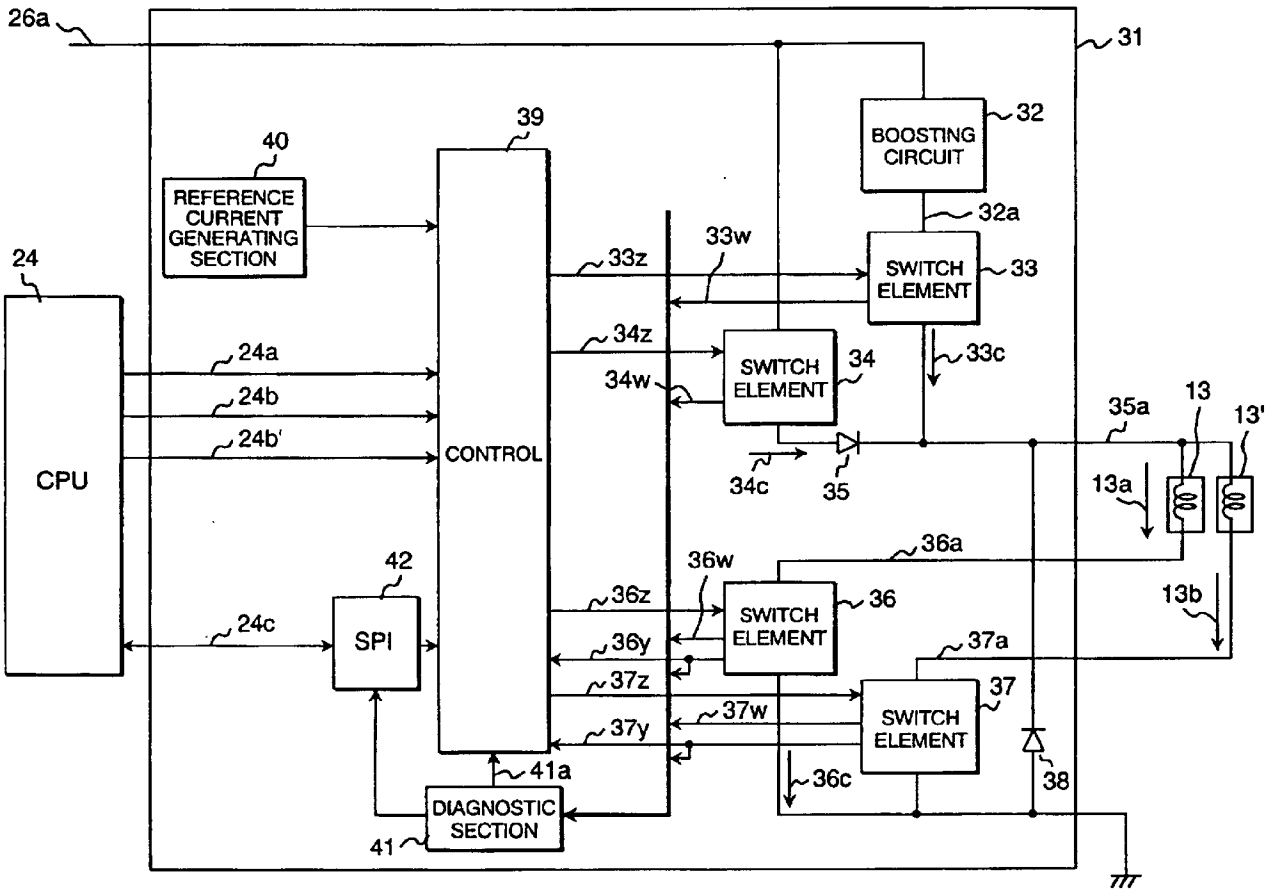
FIG. 2 is a circuit diagram for controlling an injector.

In FIG. 2, the above-mentioned switch element 33, switch element 34, back-current prevention element 35 and reflux element 38 are disposed in each opposed cylinder of the injector 13 (as an application, the switch element 33, switch element 34, back-current prevention element 35 and reflux element 38 may be disposed in each injector 13.)

There are a control section 39 for controlling the above-mentioned switch elements 33, 34, 36 and 37, and a reference current generating section 40 for setting reference current that flows through the injector 13.

An interface between the CPU 24 and the injector control circuit 31 consists of parallel inputs 24*a* and 24*b* and serial communication 24*c*. Concerning the parallel input, based on the width of the fuel injection pulse calculated by the CPU 24, a valve-opening signal 24*a* and a holding signal 24*b* are outputted from the CPU 24 and inputted into the control section 39. Serial communication 24*c* is conducted with the serial peripheral interface (SPI) section 42 located in the injector control circuit 31, and diagnosis results provided by the diagnostic section 41 are fed back to the CPU 24.

Figure 3:
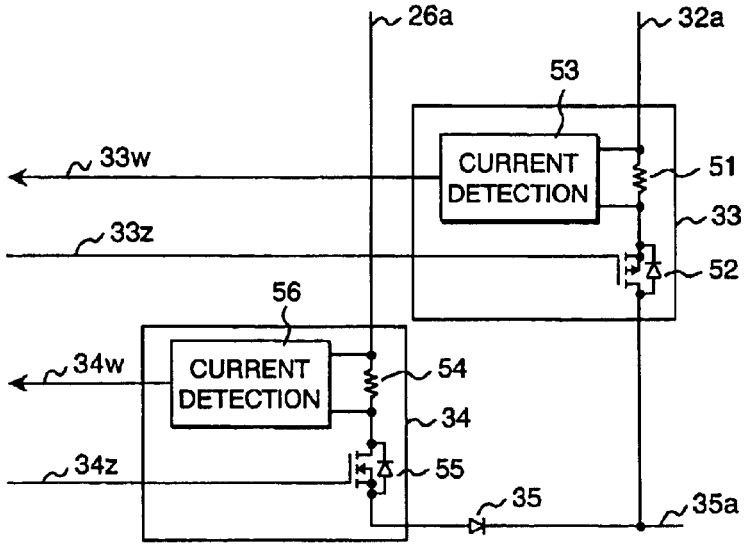
FIG. 3 is a circuit diagram of an upstream switch element.

FIG. 3 illustrates configuration of the internal circuit of the switch elements 33 and 34. The switch element 33 consists of a current voltage conversion element 51, P-channel MOSFET 52, and a current detector 53 for detecting current from the potential difference between both ends of the current voltage conversion element 51.

The P-channel MOSFET 52 is turned ON and OFF by a control signal 33*z* sent by the control section 39. Electric current flowing through the P-channel MOSFET 52 when it is ON is detected by the current voltage conversion element 51 and the current detector 53, and then the current value 33*w* is outputted to the diagnostic section 41.

The configuration of the internal circuit of the switch element 34 is basically the same as that of the switch element 33. That is, it consists of a current voltage conversion element 54, N-channel MOSFET 55, and a current detector 56 for detecting current from the potential difference between both ends of the current voltage conversion element 54. Herein, the MOSFET is specified as P-channel 52 and N-channel 55, however, either N-channel or P-channel is applicable in each configuration.

The N-channel MOSFET 55 is turned ON and OFF by a control signal 34*z* sent by the control section 39. Electric current flowing through the N-channel MOSFET 55 when it is ON is detected by the current voltage conversion element 54 and the current detector 56, and then the current value 34*w* is outputted to the diagnostic section 41.

Figure 4:
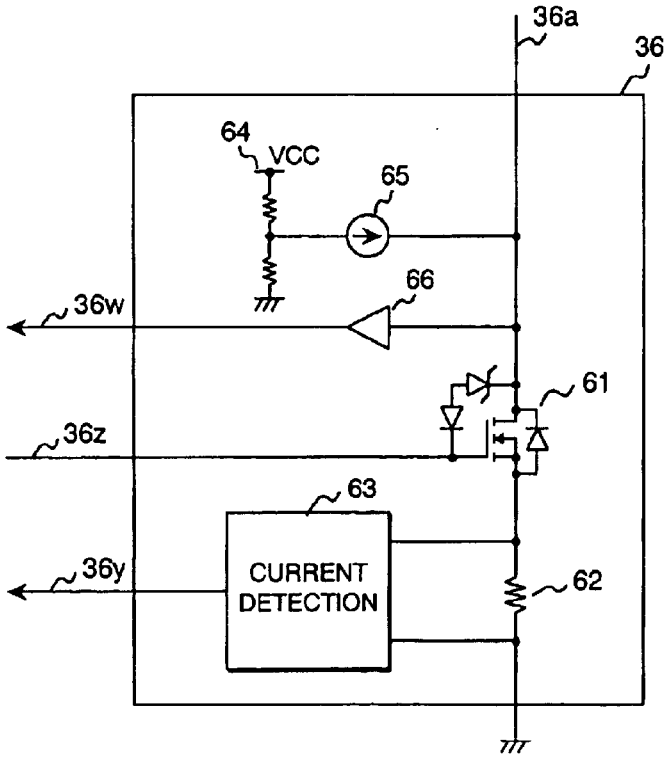
FIG. 4 is a circuit diagram of a downstream switch element.

FIG. 4 illustrates the configuration of the internal circuit of the switch element 36. Because the switch element 37 has the same configuration, only switch element 36 is described.

The N-channel MOSFET 61 is turned ON and OFF by a control signal 36*z* sent by the control section 39. The current detector 63 detects a potential difference between both ends of the current voltage conversion element 62 which detects electric current flowing through the MOSFET 61 when it is ON, and then outputs the current value 36*y* to the control section 39 and the diagnostic section 41. The control section 39 detects the current value 13*a* flowing through the injector 13 according to the signal of the current value 36*y* thereby controlling the current.

A bias voltage device 64 for generating fixed bias voltage generates bias voltage based on the voltage (VCC) generated in the control unit 31 (not shown). It generates a predetermined bias voltage by means of the resistive potential division from the VCC.

A constant current source 65, which applies a predetermined voltage generated by the bias voltage device 64 to the signal line 36*a*, biases a small amount of current which will not affect the control of the injector 13. When high impedance is experienced in the signal line 36*a*, the signal line 36*a* maintains its predetermined voltage due to the constant current source 65. A buffer 66 is disposed to divide impedance between the signal line 36*a* and the voltage signal 36*w*. That is, the impedance on the signal line 36*a* side is significantly high. Also, the voltage signal 36*w* is outputted to the diagnostic section 41.

Figure 5:
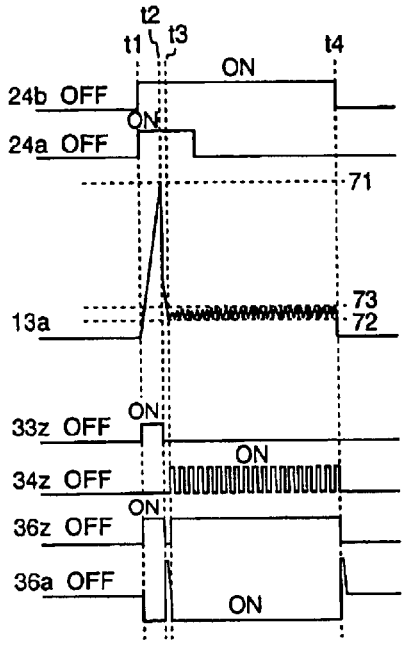
FIG. 5 illustrates the waveform of injector drive current.

FIG. 5 shows the injector 13 driving waveform created by fuel injection signals sent from the CPU, that is, valve-opening signal 24*a* and holding signal 24*b*.

Timing t1 is the timing for which the injector 13 starts to inject fuel. When the logical product of the valve-opening signal 24*a* and the holding signal 24*b* sent from the CPU 24 has been formed, the switch elements 33 and 36 are turned ON, and injector drive current 13*a* flows from the switch element 33 through the injector 13 and then through the switch element 36 and finally to the ground. Then, valve-opening current 13*a* is supplied from the boosted voltage 32*a* to the injector 13 until the current value reaches the predetermined current value 71, thereby opening the valve of the injector 13.

At this point, injector drive current 13*a* is detected by the current voltage conversion element 62 located in the switch element 36, and the detected value 36*y* is compared with the reference signal generated by the reference current generating section 40, causing the predetermined value of the current to flow.

At timing t2 at which the current has reached the predetermined value 71, the switch elements 33 and 36 are turned OFF and the supply of injector drive current 13*a* is shut down.

At timing t3, it is detected that the injector drive current 13*a* has decreased to the predetermined current value 72, the switch elements 34 and 36 are turned ON by control signals 34*z* and 36*z* sent by the control section 39, and injector drive current 13*a* is applied from battery voltage 26*a* through the switch element 34, and then through the backflow prevention element 35, injector 13, switch element 36 and finally to the ground; thereby turning ON the switch element 34 until the current reaches the predetermined current value 73.

At this point, injector drive current 13*a* is detected by the current voltage conversion element 62 located in the switch element 36, and the detected value 36*y* is compared with the reference signal generated by the reference current generating section 40, causing the predetermined value of the current to flow. During the time period from t3 to t4 until the holding signal 24*b* is turned OFF, the above-mentioned switch element 34 repeatedly turns ON and OFF thereby controlling the injector drive current 13 so that it remains constant between the predetermined values 72 and 73. The purpose of this constant current control is to keep the valve of the injector 13 open. When the switch element 34 is turned OFF, injector drive current 13*a* flows from the ground, through the reflux element 38, and then through the injector 13, switch element 36 and finally to the ground.

At timing t4, the holding signal 24*b* is turned OFF, thereby shutting down the injector drive current 13*a* and stopping fuel injection. In addition, at timing t4, both switch elements 34 and 36 are turned OFF, which means that both switch elements controlling upstream and downstream currents of the injector 13 are turned OFF, thereby quickly reducing the injector drive current 13*a* and causing the injected fuel of injector 13 to stop as the result of being linked with the holding signal 24*b*.

FIGS. 6 through 16 show the diagnostic method performed by the fuel supply system.

Figure 6:
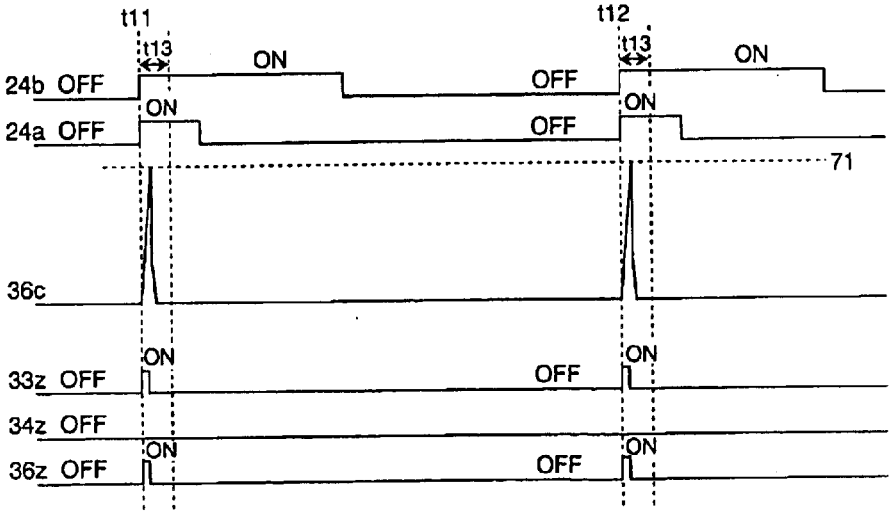
FIG. 6 illustrates the waveform of injector drive current when upstream and downstream currents are short-circuited.

FIG. 6 shows current 36*c* that flows through the switch element 36 when upstream and downstream currents of the injector 13 have been short-circuited, that is, the signal line 35*a* and the signal line 36 have been short-circuited.

At timing t11, the logical product of the valve-opening signal 24*a* and the holding signal 24*b* sent by the CPU 24 is formed, and the control section 39 outputs control signals 33*z* and 36*z* to turn ON the switch elements 33 and 36. However, if the signal line 35*a* has been short-circuited to the signal line 36*a*, the gradient at the rise of the current 36*c* is steep because of the lack of inductance component in the injector 13. At this point, if valve-opening current 36*c* reaches a predetermined value 71 within the predetermined time t13 after the logical product of the valve-opening signal 24*a* and the holding signal 24*b* has been formed, the diagnostic section 41 diagnoses that the injector's upstream and downstream currents have been short-circuited and outputs an NG code, "Short to High Side Driver."

The current flowing through the switch element 36 is detected by the current voltage conversion element 62 located in the switch element 36, and the current detection signal 36*y* is inputted into the diagnostic section 41. The current can be detected by comparing it with the predetermined valve-opening current value 71.

At the time of the diagnosis, in order to protect switch elements 33 and 36 from being damaged by over-current, the control section 39 receives a diagnosis result from the diagnostic section via the signal line 41*a* and turns OFF control signals 33*z* and 36*z*, thereby turning OFF the switch elements 33 and 36.

The recovery timing at which the switch elements that have been turned OFF due to the protection operation will recover is the timing for starting the next fuel injection, that is, timing t12. If the short-circuit condition still remains at timing t12, operation similar to the above-mentioned operation will take place.

Figure 7:
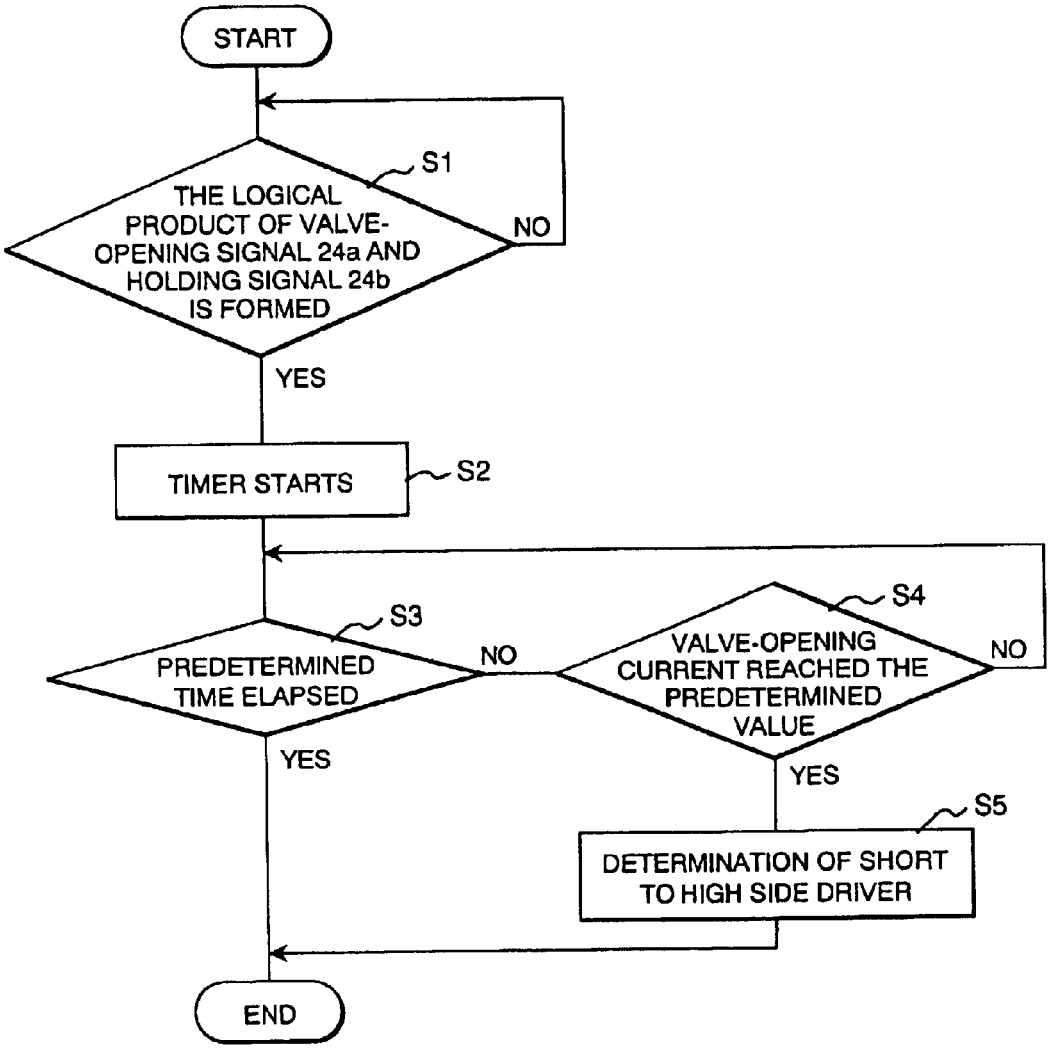
FIG. 7 is a diagnostic flowchart when upstream and downstream currents are short-circuited.

FIG. 7 is a diagnostic flowchart in the case of a short-circuit between the signal line 35*a* and the signal line 36*a* shown in FIG. 6.

When the logical product of the valve-opening signal 24*a* and the holding signal 24*b* has been formed, this diagnosis starts as follows (S1).

When diagnosis starts according to S1, the timer starts in S2 to measure the predetermined time from the formation of the logical product of the valve-opening signal 24*a* and the holding signal 24*b*.

If valve-opening current reaches the predetermined value 71 in S4 before the timer counts the predetermined elapsed time in S3, that is, a short-circuit between the signal line 35*a* and the signal line 36*a* causes the absence of the inductance component in the injector 13 thereby the delay in current rise is shorter than the predetermined time, the diagnosis "Short to High Side Driver" is determined in S5.

On the contrary, if current has not reached the predetermined valve-opening current value 71, the process jumps to the determination condition S3 and transits the determination conditions in a loop from S3 to S4 and returns to S3 until the timer measures the predetermined time in S3.

If the timer measured the elapsed predetermined time in S3, this diagnosis is considered to be normal and the diagnostic process will end.

Figure 8:
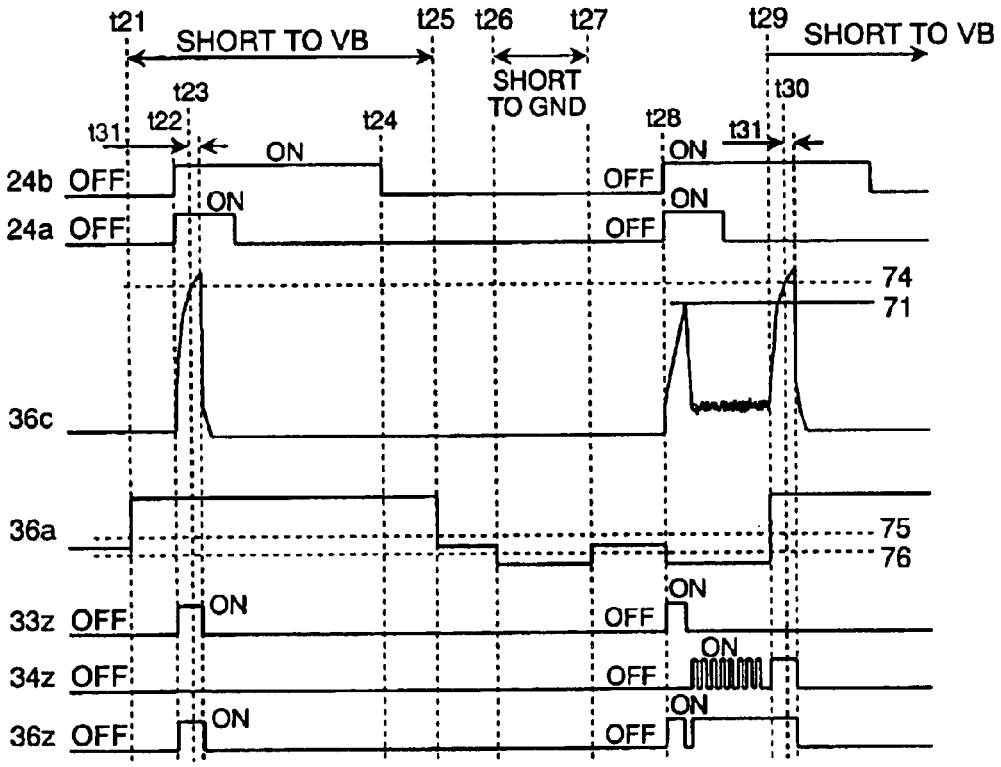
FIG. 8 illustrates the waveform of injector drive current when the downstream switch is short-circuited to the battery or to ground.

FIG. 8 shows the change of current 36*c* flowing through the switch element 36 and the change of the voltage in the signal line 36*a* when the signal line 36*a* of the switch element 36 located downstream of the injector is short-circuited to the battery or to ground.

In FIG. 8, the signal line 36*a* is short-circuited to the battery during the time period from timing t21 to t25 and after t29. It is short-circuited to ground during the time period from timing t26 to t27.

When the injector drive signal is OFF, which means that the valve-opening signal 24*a* and the holding signal 24*b* are OFF, voltage of the signal line 36*a* is biased to a predetermined voltage by the constant current source 65 usually located in the switch element 36.

However, when the signal line 36*a* is short-circuited to the battery at timing t21, voltage of the signal line 36*a* rises in close proximity to the battery voltage. The diagnostic section 41 monitors this condition by sensing the voltage signal 36*w* via the buffer 66. If the voltage value becomes larger than the predetermined voltage 75 when the injector drive signal is OFF, the diagnostic section 41 diagnoses the condition as "Short to VB."

Timing t22 is the timing for supplying valve-opening current when the logical product of the valve-opening signal 24*a* and the holding signal 24*b* is formed. At this point, control signals 33*z* and 36*z* sent from the control section 39 are turned ON, and those signals turn ON the switch elements 33 and 36.

However, because the signal line 36*a* has been short-circuited to the battery, at timing t23, current 36*c* flowing through the switch element 36 exceeds the over-current determination threshold 74 specified in the diagnostic section 41. Current flowing through the switch element 36 is detected by the current voltage conversion element 62 located in the switch element 36, and the current detection signal 36*y* is inputted into the diagnostic section 41. The current can be detected by comparing it with the over-current determination threshold 74.

If the condition in which the current still exceeds the over-current determination threshold 74 (timing t23) for t31, in order to protect the switch element 36 from being damaged by over-current, the control section 39 turns OFF the control signal 36*z* and simultaneously turns OFF the control signal 33*z* so as to turn OFF the upstream switch element 33.

Timing t24 is essentially the timing for stopping the fuel injection. However, since control signals 33*z* and 36*z* have been turned OFF due to the over-current diagnosis, the drive signal dose not change.

Timing t25 is the recovery timing from the battery short-circuit condition. At this point, voltage of the signal line 36*a* is biased by the constant current source 65 to a predetermined voltage which is less than the battery short-circuit determination voltage value 75.

If the signal line 36*a* is short-circuited to ground at timing t26, voltage of the signal line 36*a* drops in close proximity to the ground voltage. The diagnostic section 41 monitors this condition by sensing the voltage signal 36*w* via the buffer. If the voltage becomes less than the predetermined voltage 76 when the injector drive signal is OFF, the diagnostic section 41 diagnoses the condition as "Short to GND."

In this drawing, the ground short-circuit state of the signal line 36*a* is to recover normally at timing t27. Timing t27 is the recovery timing from the ground short-circuit state. At this point, voltage of the signal line 36*a* is biased by the constant current source 65 to the predetermined voltage which is larger than the ground short-circuit determination voltage value 76.

Timing t28 is the timing for starting the next fuel injection. At this timing, the over-current protection condition is released. Also at this timing, since the signal line 36*a* has been recovered and is in a normal condition, current 36*c* flowing through the switch element 36 is normal, and turning ON the switch element 36 will cause the voltage of the signal line 36*a* to become a ground level.

However, at the timing for supplying the holding current, that is, when the valve-opening signal 24*a* is OFF and the holding signal 24*b* is ON, if the battery short-circuit condition is present at timing t29, current 36*c* flowing through the switch element 36 exceeds the over-current determination threshold 74. The current flowing through the switch element 36 is detected by the current voltage conversion element 62 located in the switch element 36, and the current detection signal 36*y* is inputted to the diagnostic section 41. The current is compared with the over-current determination threshold 74.

If the current continuously exceeds the over-current determination threshold 74 (timing t30) for t31, in order to protect the switch element 36 from being damaged by over-current, the control section 39 turns OFF the control signal 36*z* and simultaneously turns OFF the control signal 33*z* so as to turn OFF the upstream switch element 33.

The release timing from the over-current damage protection condition is the timing for starting the next fuel injection which is the same as timing t28.

Figure 9:
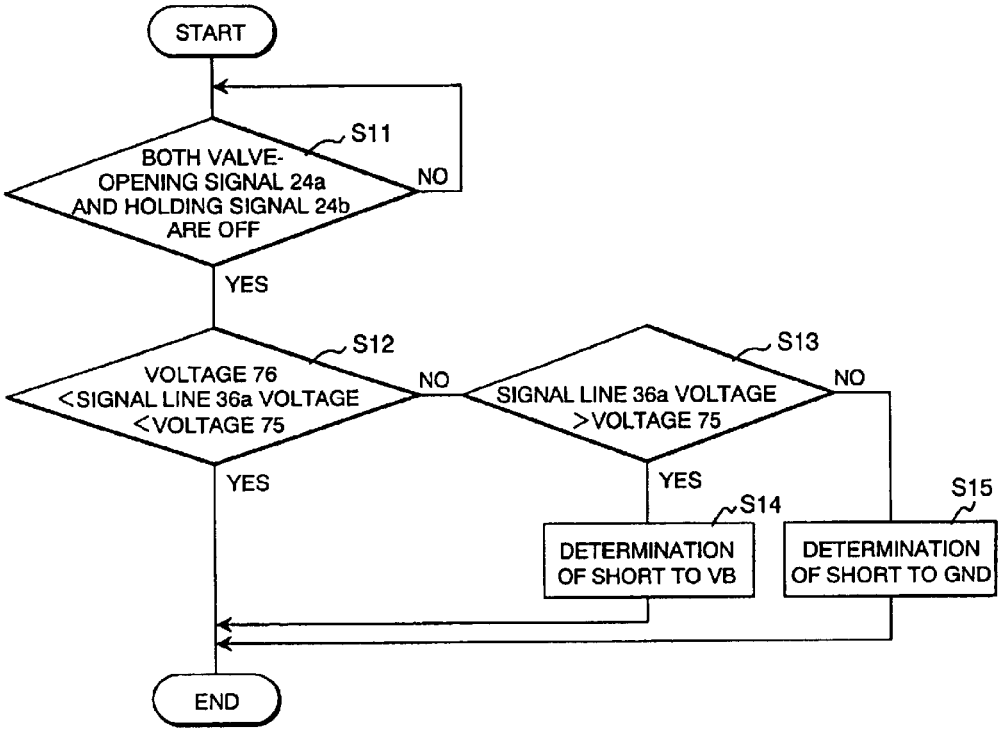
FIG. 9 is a diagnostic flowchart for the downstream switch.

FIG. 9 is a diagnostic flowchart when the signal line 36*a*, shown in FIG. 8, is short-circuited to the battery or to ground.

When both the valve-opening signal 24*a* and the holding signal 24*b* are OFF, this diagnosis starts as follows (S11).

In the normal condition, voltage of the signal line 36*a* is biased by the constant current source 65 located in the switch element 36. The predetermined voltage is larger than the ground short-circuit determination voltage value 76 and less than the battery short-circuit determination voltage value 75.

When voltage of the signal line 36*a* is within the range under determination condition S12, that is, it is between the ground short-circuit determination voltage value 76 and the battery short-circuit determination voltage value 75, the condition is normal.

On the contrary, if the voltage of the signal line 36*a* is not within the voltage range in S12, the process jumps to S13.

If voltage of the signal line 36*a* is larger than the battery short-circuit determination voltage value 75 in S13, the signal line is short-circuited to the battery, and therefore, the "Short to VB" diagnosis is made in S14.

If the voltage value is not within the range of the S13 conditions, it is indicated that the voltage of the signal line 36*a* is less than the ground short-circuit determination voltage value 76, which is considered to be the ground short-circuit condition; therefore, the "Short to GND" diagnosis is made in S15.

This diagnosis is made when both the valve-opening signal 24*a* and the holding signal 24*b* are OFF.

Figure 10:
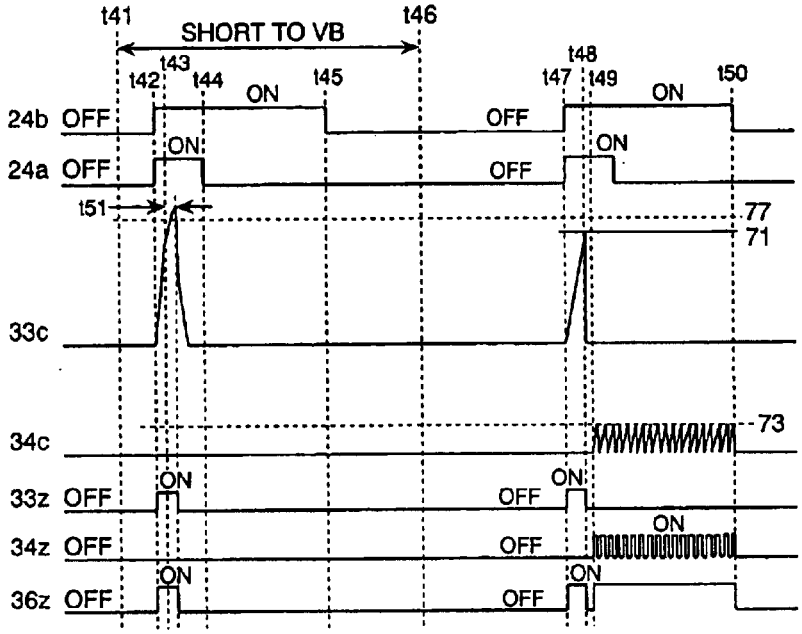
FIG. 10 illustrates the waveform of injector drive current when the upstream switch is short-circuited to the battery.

FIG. 10 shows the waveform of currents 33*c* and 34*c* that flow through switch elements 33 and 34 when the signal line 35*a* located upstream of the injector 13 is short-circuited to the battery. In this drawing, a short-circuit to the battery is present from t41 to t46.

At fuel injection start timing t42 after the signal line 35*a* has been short-circuited to the battery, so as to turn ON the switch elements 33 and 36, the control section 39 outputs control signals 33*z* and 36*z*.

Those ON signals turn ON switch elements 33 and 36 thereby beginning the flow of current 33*c*. However, at this point, because the signal line 35*a* has been short-circuited to the battery, the value of the current 33*c* becomes large due to the lack of resistance components.

Current 33*c* is detected by the current voltage conversion element 51 located in the switch element 33, and the detected current value 33*w* is inputted into the diagnostic section 41. If the value of the current remains larger than the over-current detection threshold 77 (t43) for t51, so as to protect the switch element 33 from being damaged by over-current, the diagnostic section 41 turns OFF the control signal 33*z* sent by the control section 39. At the same time, it also turns OFF the control signal 36*z* to simultaneously turn OFF the downstream switch element 36 which works in conjunction with the switch element 33.

Timing t44 is the timing for supplying the holding current when the valve-opening signal 24*a* is OFF and the holding signal 24*b* is ON. However, it is an over-current damage protection condition; therefore, currents 33*c* and 34*c* do not change.

Timing t45 is the timing for stopping the fuel injection. However, it is an over-current damage protection condition; therefore, currents 33*c* and 34*c* do not change.

Timing t47 is the timing for starting the next fuel injection. At t46, before timing t47, the signal line 35*a* has been recovered from the battery short-circuit state and is in the normal condition; therefore, normal current flows after t47. That is, at timing t47, when the logical product of the valve-opening signal 24*a* and the holding signal 24*b* is formed, switch elements 33 and 36 are turned ON, thereby supplying valve-opening current 33*c* to the injector 13.

At timing t48, if current flowing through the switch element 36 has reached the predetermined value 71, the switch elements 33 and 36 are turned OFF.

When the switch element 36 detects (t49) that the current is less than the current threshold 72, it turns ON the switch element 34 and supplies holding current to the injector 13 until the current reaches the current threshold 73. The switch element 34 repeatedly turns ON and OFF to supply holding current to the injector 13 until the holding signal 24*b* is turned OFF.

Figure 11:
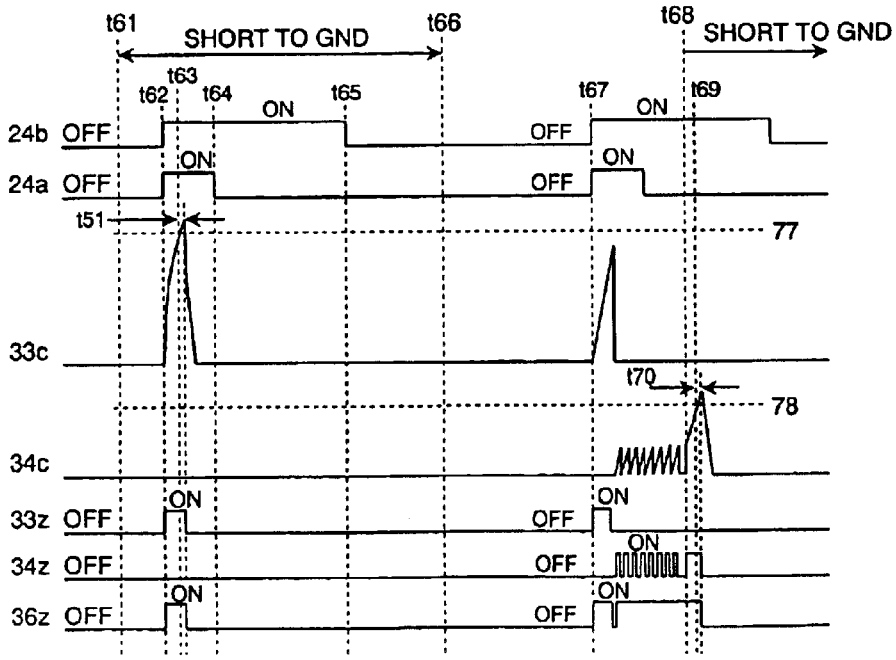
FIG. 11 illustrates the waveform of injector drive current when the upstream switch is short-circuited to ground.

FIG. 11 shows the waveform of currents 33*c* and 34*c* that flow through switch elements 33 and 34 when the signal line 35*a* located upstream of the injector 13 is short-circuited to ground. In this drawing, a short-circuit to ground is present from t61 to t66 and after t68.

At fuel injection start timing t62 after the signal line 35*a* has been short-circuited to ground, so as to turn ON the switch elements 33 and 36, the control section 39 outputs control signals 33*z* and 36*z*. Those ON signals turn ON switch elements 33 and 36 thereby beginning the flow of current 33*c*. However, at this point, because the signal line 35*a* has been short-circuited to ground, the value of the current 33*c* becomes large due to the lack of resistance components. Current 33*c* is detected by the current voltage conversion element 51 located in the switch element 33, and the detected current value 33*w* is inputted into the diagnostic section 41. If the value of the current remains larger than the over-current detection threshold 77 (t63) for t51, so as to protect the switch element 33 from being damaged by over-current, the diagnostic section 41 turns OFF the control signal 33*z* sent by the control section 39. At the same time, it also turns OFF the control signal 36*z* to simultaneously turn OFF the downstream switch element 36 which works in conjunction with the switch element 33.

Timing t64 is the timing for supplying the holding current when the valve-opening signal 24*a* is OFF and the holding signal 24*b* is ON. However, it is an over-current damage protection condition; therefore, currents 33*c* and 34*c* do not change.

Timing t65 is the timing for stopping the fuel injection. However, it is an over-current damage protection condition; therefore, currents 33*c* and 34*c* do not change.

Timing t67 is the timing for starting the next fuel injection. At t66, before timing t67, the signal line 35*a* has been recovered from the ground short-circuit state and is in the normal condition; therefore, normal current flows after t67.

However, at the timing for supplying the holding current, that is, when the valve-opening signal 24*a* is OFF and the holding signal 24*b* is ON, if the signal line 35*a* is short-circuited to ground, the value of the current 34*c* flowing through the switch element 34 becomes large due to the lack of resistance components. Current 34*c* is detected by the current voltage conversion element 54 located in the switch element 34, and the detected current value 34*w* is inputted into the diagnostic section 41. If the value of the current remains larger than the over-current detection threshold 78 (t69) for t70, so as to protect the switch element 34 from being damaged by over-current, the diagnostic section 41 turns OFF the control signal 34*z* sent by the control section 39. At the same time, it also turns OFF the control signal 36*z* to simultaneously turn OFF the downstream switch element 36 which works in conjunction with the switch element 34.

The recovery timing from the over-current damage protection state is the next fuel start timing.

Figure 12:
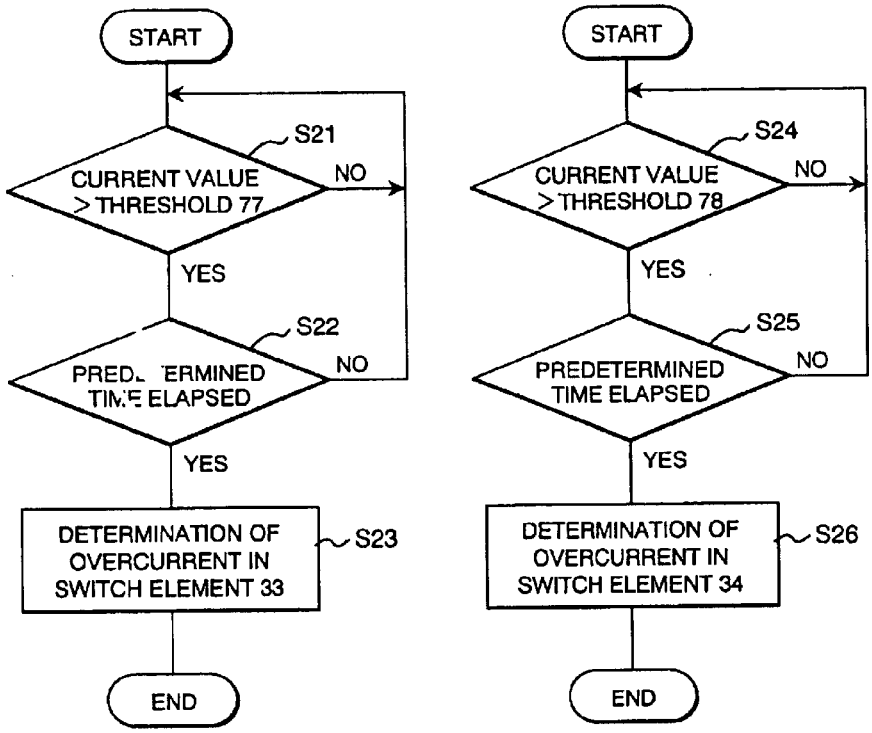
FIG. 12 is a diagnostic flowchart for the upstream switch.

FIG. 12 is an over-current diagnosis flowchart for the switch elements 33 and 34 shown in FIGS. 10 and 11.

Conditions S21 through S23 are for over-current diagnosis for the switch element 33, and conditions S24 through S26 are for over-current diagnosis for the switch element 34.

S21 determines whether or not current 33*c* flowing through the switch element 33 is larger than the over-current determination threshold 77. When the determination result is "NOT," the condition is normal; and therefore the process returns to S21. On the contrary, if the current 33*c* is larger than the over-current determination threshold 77, that indicates the over-current condition; therefore, the process transits to S22 which determines whether or not the over-current condition has continued for the predetermined time. If the result is "NOT", the process returns to S21, and if the over-current condition has been continuous, the process transits in a loop from S21 to S22 and returns to S21. If the over-current condition continues for the predetermined time period, the process transits to S23 according to determination condition S22, and "Over-current determination" of the switch element 33 is performed. The predetermined time is measured in S22 by using a filter designed for increasing noise tolerance dose.

S24 determines whether or not current 33*c* flowing through the switch element 33 is larger than the over-current determination threshold 77. When the determination result is "NOT," the condition is normal; and therefore the process returns to S24. On the contrary, if the current 33*c* is larger than the over-current determination threshold 78, that indicates the over-current condition; therefore, the process transits to S25 which determines whether or not the over-current condition has continued for the predetermined time.

If the result is "NOT", the process returns to S24, and if the over-current condition has been continuous, the process transits in a loop from S24 to S25 and returns to S24. If the over-current condition continues for the predetermined time period, the process transits to S26 according to determination condition S25, and "Over-current determination" of the switch element 34 is performed. The predetermined time is measured in S25 by using a filter designed for increasing noise tolerance dose. Thus, over-current determination for switch elements 33 and 34 are conducted.

Figure 13:
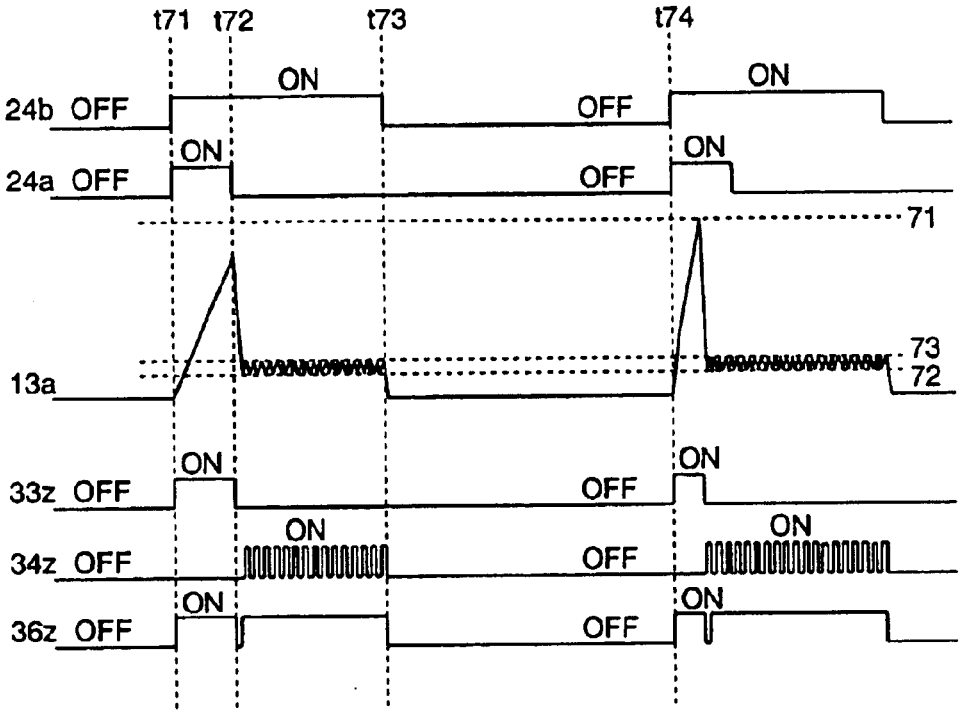
FIG. 13 illustrates the waveform of injector drive current when valve-opening current is insufficient.

FIG. 13 shows the waveform when an amount of supplied valve-opening current is insufficient. When the logical product of the valve-opening signal 24*a* and the holding signal 24*b* is formed at timing t71, valve-opening current 13*a* is supplied to the injector 13. Normally, the value of the valve-opening current reaches a predetermined current value 71 before the valve-opening signal 24*a* is turned OFF. However, if boosted voltage 32*a* has not been boosted to the value required by the injector 13, sufficient valve-opening current cannot be supplied.

Accordingly, the predetermined amount of valve-opening current cannot be supplied to the injector 13 within the predetermined time period thereby preventing the injector 13 from beginning to inject fuel. Therefore, if valve-opening current has not reached the predetermined current value 71 by timing t72 at which the valve-opening signal 24 is turned OFF after having been in the ON state, the "No Peak" diagnosis, which indicates insufficient valve-opening current, is made.

After insufficient valve-opening current has been detected at t72, holding current is supplied until timing t73 at which fuel injection is stopped.

After t74, the drawing shows the waveform in the normal condition as mentioned in FIG. 5.

To avoid misdiagnosis, this diagnosis is not conducted when an operation condition becomes abnormal while the valve-opening signal 24*a* is ON and switch elements 33 and 36 are OFF. That is, this diagnosis is not conducted when waveforms are abnormal as shown in FIGS. 6, 8, 10 and 11.

Figure 14:
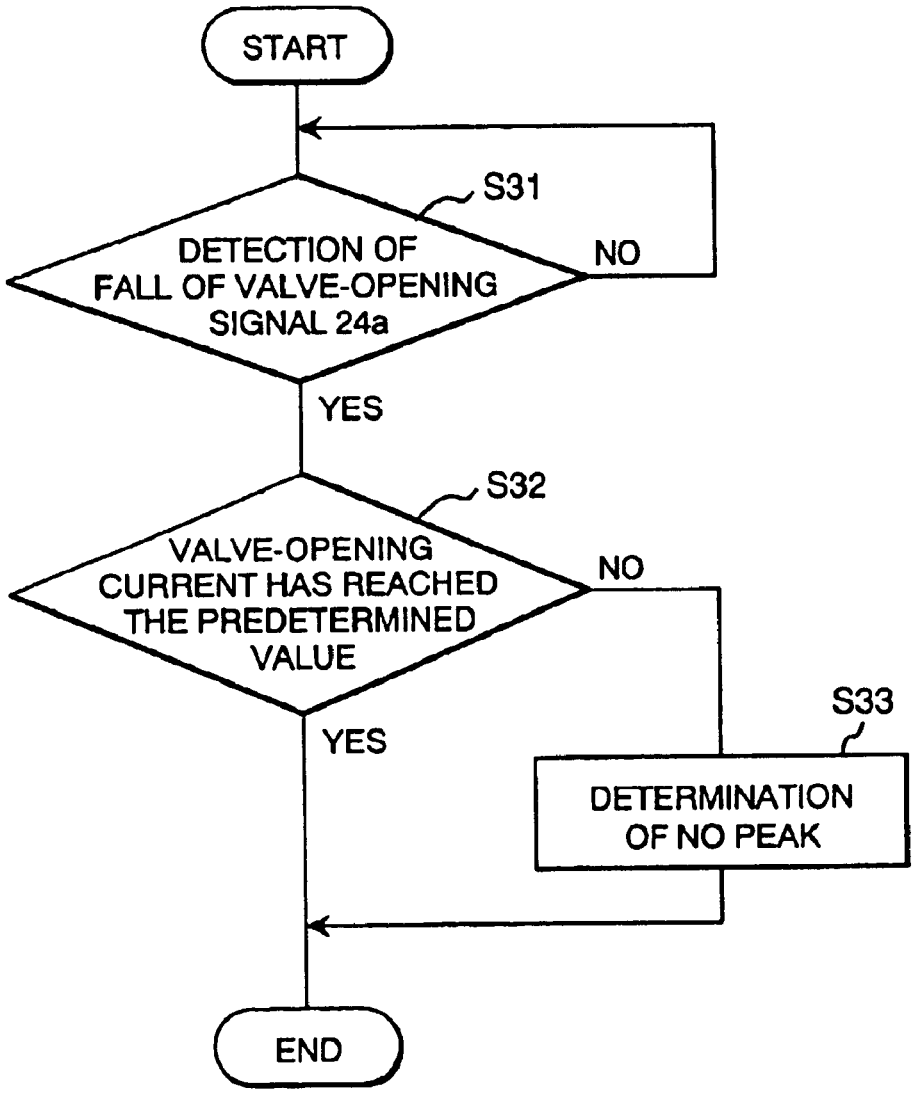
FIG. 14 is a diagnostic flowchart when valve-opening current is insufficient.

FIG. 14 is a diagnosis logic flowchart to diagnose the condition as "No Peak" which indicates insufficient valve-opening current as shown in FIG. 13.

This diagnosis is conducted at the fall of the valve-opening signal 24*a*. This diagnosis does not start until the fall of the valve-opening signal 24*a* is detected in S31. When the fall of the signal is detected in S31, the process transits to S32 which determines whether or not the valve-opening current has reached the predetermined current value. If the current has reached the predetermined current value 71, normal operation is possible, and therefore, this diagnosis is terminated.

However, if current has not reached the predetermined value, valve-opening current is not sufficient. Therefore, the process transits to S33 where the "No Peak" diagnosis is made indicating that valve-opening current is not sufficient.

Figure 15:
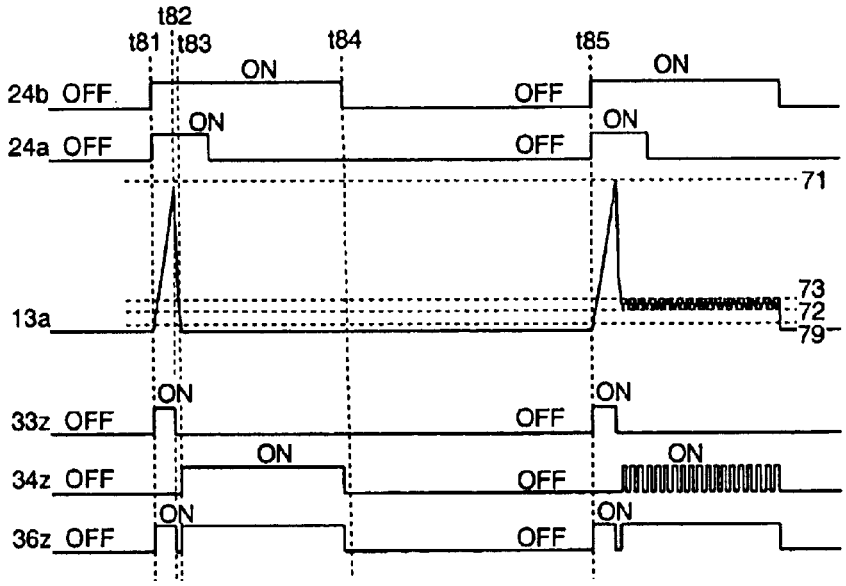
FIG. 15 illustrates the waveform of injector drive current when holding current is insufficient.

FIG. 15 shows the waveform when an amount of supplied holding current is insufficient. When the logical product of the valve-opening signal 24*a* and the holding signal 24*b* is formed at timing t81, valve-opening current 13*a* is supplied to the injector 13. Since this drawing shows the normal condition, valve-opening current 13*a* reaches the predetermined current value 71 at timing t82 before the valve-opening signal 24*a* is turned OFF.

Once current 13*a* has reached the predetermined value 71 at timing t82, control signals 34*z* and 36*z* are turned ON at t83 to supply holding current. However, if holding current 13*a* is not supplied due to an abnormality of the switch element 34, the condition does not allow holding current to be supplied. Therefore, if holding current 13*a* is less than the predetermined value 79 at the timing when the holding signal 24*b* turns OFF after having been in the ON state, the "Open Load" diagnosis is made indicating that the supply of holding current is not sufficient.

The drawing shows a normal waveform after timing t85. After valve-opening current 13*a* has reached the predetermined value 71, holding current 13*a* is regulated to remain between current 72 and current 73, which is larger than the predetermined value 79.

Figure 16:
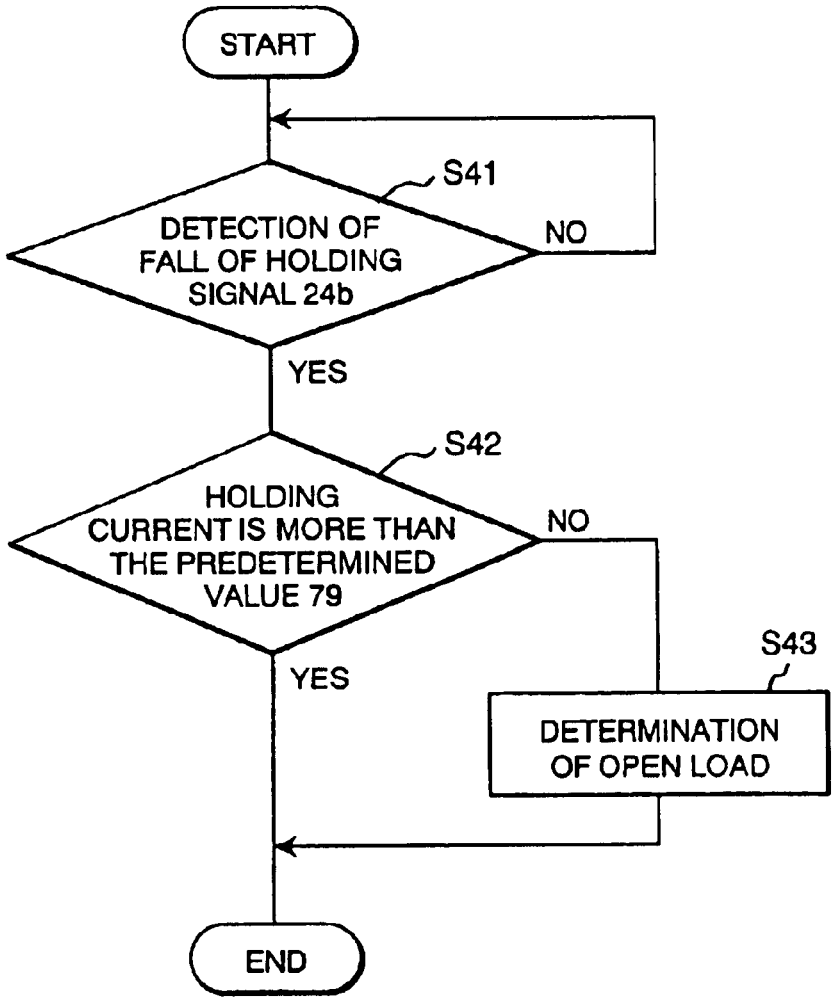
FIG. 16 is a diagnostic flowchart when holding current is insufficient.

FIG. 16 is a diagnosis logic flowchart to diagnose the condition as "Open Load" which indicates insufficient holding current as shown in FIG. 15. This diagnosis is conducted at the fall of the holding signal 24*b*. This diagnosis does not start until the fall of the holding signal 24*b* is detected in S41.

When the fall of the signal is detected in S41, the process transits to S42 which determines whether or not the holding current is more than the predetermined current value 79. If the current is more than the predetermined current value 79, it is a normal condition; and therefore, this diagnosis is terminated.

However, if the current is not more than predetermined current value 79, holding current is not sufficient. Therefore, the process transits to S43 and the "Open Load" diagnosis is made indicating that holding current is not sufficient.

To avoid misdiagnosis, this diagnosis is not conducted when an operation condition becomes abnormal while the holding signal 24*b* is ON and switch elements 34 and 36 are OFF. That is, this diagnosis is not conducted when waveforms are abnormal as shown in FIGS. 6, 8, 10 and 11.

Figure 17:
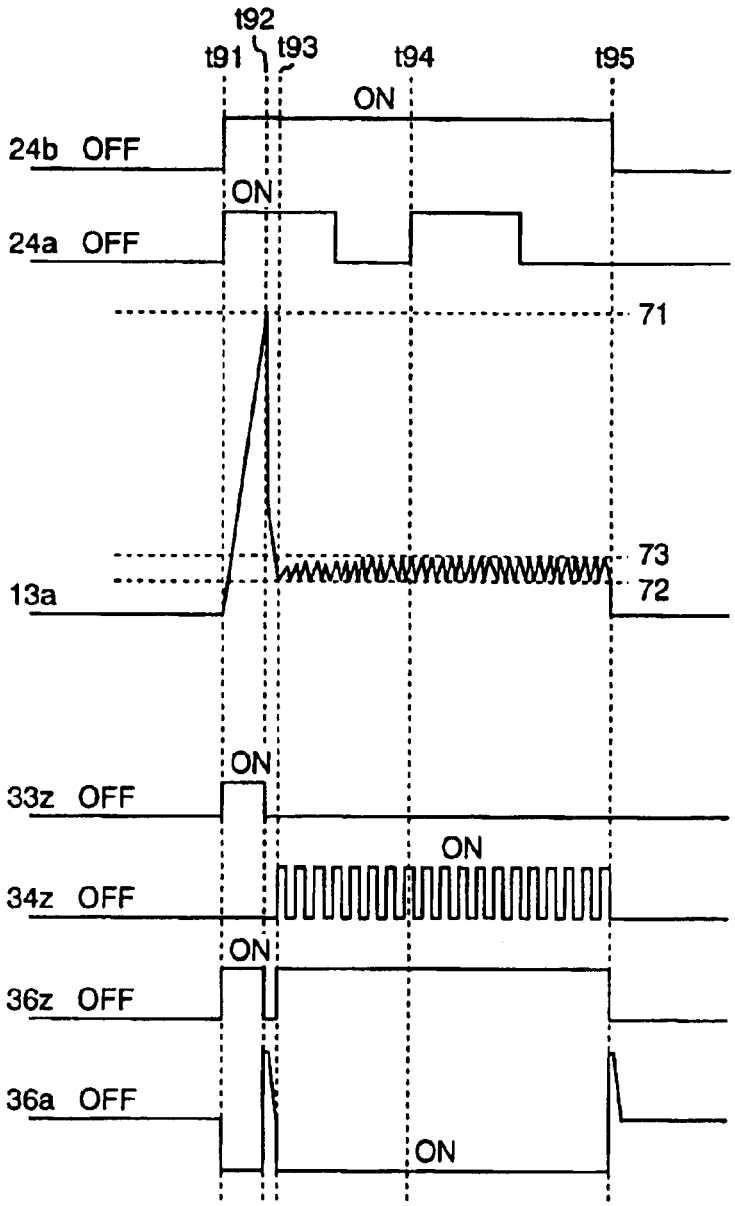
FIG. 17 illustrates the waveform of injector drive current when valve-opening signal has been inputted twice.
Figure 18:
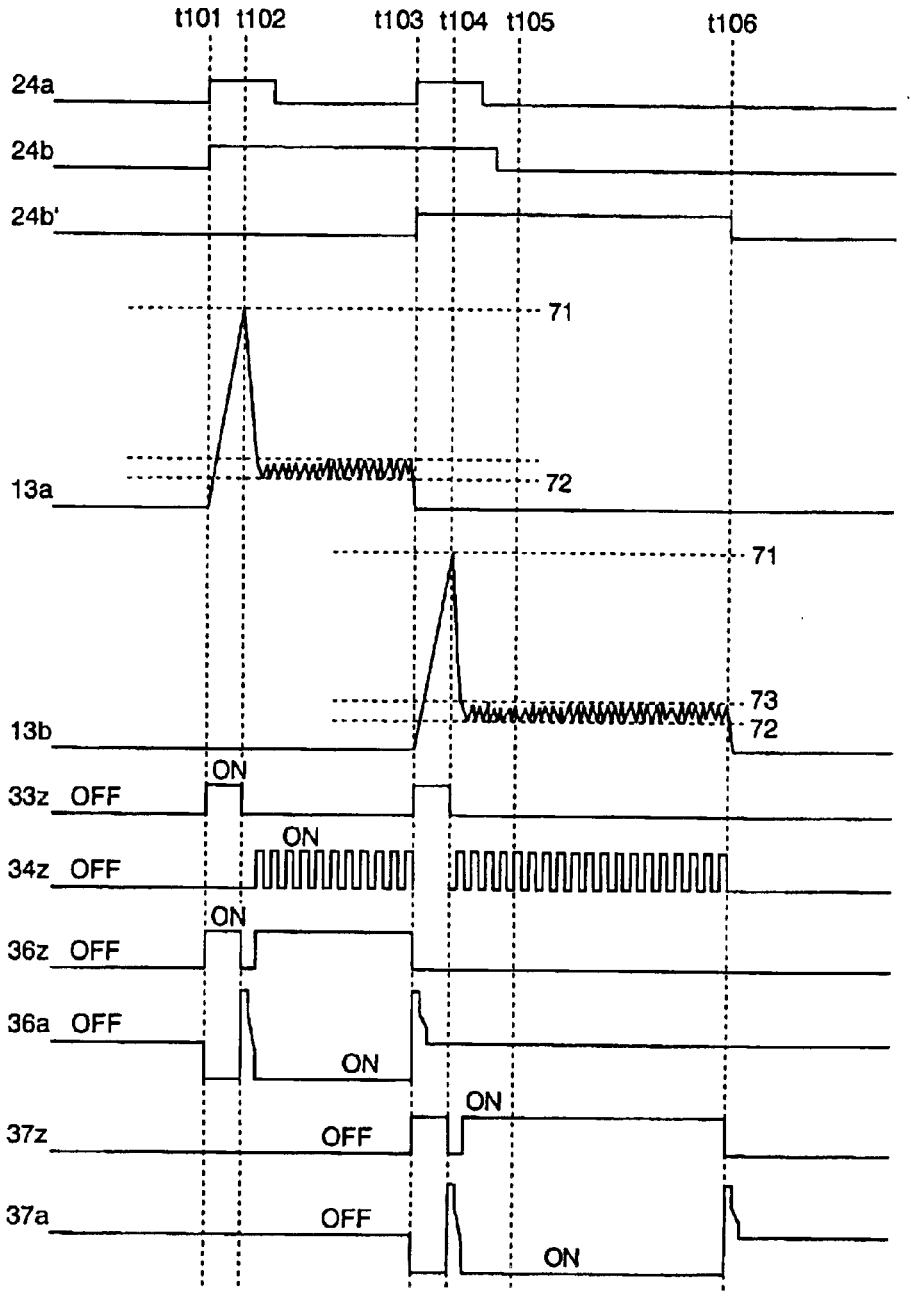
FIG. 18 illustrates the waveform of injector drive current when the timing of the opposed cylinder coincides.

FIGS. 17 and 18 show a misdiagnosis prevention method for a fuel supply system according to the present invention. FIG. 17 shows the valve-opening signal 24*a* input processing. Timing t91 is the timing at which the injector 13 begins to inject fuel. When the logical product of the valve-opening signal 24*a* and the holding signal 24*b* sent by the CPU 24 has been formed, switch elements 33 and 36 are turned ON, injector drive current 13*a* is made to flow from the switch element 33 through the injector 13 and then through switch element 36 and finally to the ground. Valve-opening current 13*a* is supplied from boosted voltage 32*a* to the injector 13 until the current value reaches the predetermined current value 71, thereby opening the valve of the injector 13.

At timing t92 when the current has reached the predetermined current value 71, switch elements 33 and 36 are turned OFF, thereby shutting down the supply of injector drive current 13*a*.

At timing t93, it is detected that the injector drive current 13*a* has decreased to the predetermined current value 72, switch elements 34 and 36 are turned OFF according to control signals 34*z* and 36*z* sent by the control section 39, and injector drive current 13*a* is supplied from battery voltage 26*a* via the switch element 34 through the backflow prevention element 35, and then through the injector 13, switch element 36 and finally to the ground, thereby turning ON the switch element 34 until the current reaches the predetermined current value 73. During the time period from t3 to t4 until the holding signal 24*b* is turned OFF, the above-mentioned switch element 34 repeatedly turns ON and OFF thereby controlling injector drive current 13*a* so that it remains constant between the predetermined values 72 and 73.

The valve-opening signal 24*a* is turned ON again at timing t94, forming the logical product of the valve-opening signal 24*a* and the holding signal 24*b*, it is the timing for supplying the valve-opening current. However, it is not necessary to supply valve-opening current twice during the fuel injection period from t91 to t95. In addition, if valve-opening current supply intervals are short, the boosting time for boosted voltage 32*a* generated by the booster circuit 32 is too short; consequently, there is a possibility that the valve-opening current supply may not be sufficient. Therefore, the valve-opening signal 24*a* is designed to be received only once while the holding signal 24*b* is ON, and current 13*a* does not change at timing t24.

At timing t95, the holding signal 24*b* is turned OFF, causing the injector drive current 13*a* to be shut down, thereby stopping fuel injection. At timing t95, switch elements 34 and 36 are turned OFF, which means that both switch elements controlling upstream and downstream currents of the injector 13 are turned OFF, thereby quickly reducing the injector drive current 13*a* and causing the injected fuel of injector 13 to stop as the result of being linked with the holding signal 24*b*.

FIG. 18 shows the processing conducted when an opposed cylinder coincides.

In FIG. 2, upstream switch elements 33 and 34 are used in common by two injectors. Therefore, if downstream switch elements 36 and 37 are simultaneously turned ON, current 33*c* and current 34*c* split into two streams, which prevents normal current from being supplied to the injector 13, thereby preventing optimal injector control. In addition, because the current splits into two streams, there is a possibility that the "No Peak" diagnosis indicating insufficient supply of valve-opening current or the "Open Load" diagnosis indicating insufficient supply of holding current may be assessed resulting in misdiagnosis. Accordingly, in this logic, to prevent the above-mentioned misdiagnosis, if there is an occurrence of an overlapping area where two downstream switch elements are simultaneously turned ON, the priority is given to the latter cylinder and the fuel injection process which has already begun is terminated. Details of the timing will be explained below.

Timing t101 is the timing at which the injector 13 begins to inject fuel. When the logical product of the valve-opening signal 24*a* and the holding signal 24*b* sent by the CPU 24 has been formed, switch elements 33 and 36 are turned ON, and injector drive current 13*a* is made to flow from the switch element 33 through the injector 13 and then through the switch element 36 and finally to the ground. And, valve-opening current 13*a* is supplied from boosted voltage 32*a* to the injector 13 until the current value reaches the predetermined current value 71, thereby opening the valve of the injector 13.

At timing t102 when the current has reached the predetermined current value 71, switch elements 33 and 36 are turned OFF, thereby shutting down the supply of the injector drive current 13*a*. When it is detected that the injector drive current 13*a* has decreased to the predetermined current value 72, the switch elements 34 and 36 are turned ON according to control signals 34*z* and 36*z* sent by the control section 39, and injector drive current 13*a* are supplied from battery voltage 26*a* via the switch element 34 through the backflow prevention element 35, and then through the injector 13, switch element 36 and finally to the ground, thereby turning ON the switch element 34 until the current reaches the predetermined current value 73. During the time period until the holding signal 24*b* is turned OFF, the above-mentioned switch element 34 repeatedly turns ON and OFF thereby controlling the injector drive current 13 so that it remains constant between the predetermined values 72 and 73.

When the valve-opening signal 24*a* and the holding signal 24*b*' for the opposed cylinder are inputted at timing t103, switch elements 33 and 37 are turned ON, injector drive current 13*b* is supplied from the switch element 33 through the injector 13 and then through the switch element 37 and finally to the ground. The injector drive current 13*b* is supplied from boosted voltage 32*a* to the opposed cylinder's injector 13' until the current reaches the predetermined current value 71, thereby opening the valve of the opposed cylinder's injector 13'.

At this point, the switch element 36 is turned OFF to stop injector current 13*a* which has been flowing. Accordingly, because holding current 13*a* does not flow when the holding signal 24*b* is turned ON after having been in the OFF state, the "Open Load" diagnosis for the stopped cylinder is not made so as to prevent misdiagnosis which indicates that the supply of holding current is not sufficient.

At timing t104 when the current has reached the predetermined current value 71, switch elements 33 and 37 are turned OFF, thereby shutting down the supply of the injector drive current 13*a*. When it is detected that the injector drive current 13*a* has decreased to the predetermined current value 72, switch elements 34 and 37 are turned ON according to control signals 34*z* and 37*z* sent by the control section 39, injector drive current 13*b* is supplied from battery voltage 26*a* via the switch element 34 through the backflow prevention element 35 and then through the injector 13, switch element 37 and finally to the ground, thereby turning ON the switch element 34 until the current reaches the predetermined current value 73. During the time period until the holding signal 24*b*' is turned OFF, the above-mentioned switch element 34 repeatedly turns ON and OFF thereby controlling the injector drive current 13*b* so that it remains constant between the predetermined values 72 and 73.

At timing t106, the holding signal 24*b*' is turned OFF, causing the injector drive current 13*b* to be shut down, thereby stopping fuel injection. At timing t106, switch elements 34 and 37 are turned OFF, which means that both switch elements controlling upstream and downstream currents of the injector 13' are turned OFF, thereby quickly reducing the injector drive current 13*b* and causing the injected fuel of injector 13' to stop as the result of being linked with the holding signal 24*b*'.

While the invention has been described with respect to one embodiment of the present invention, the present invention is not limited to the embodiment, but other embodiments can be devised which do not depart from the scope of the invention as described herein.

For example, although the injector's current waveform is composed of one valve-opening current and one holding current, the holding current can have two different values. This means that the present invention is applicable for an injector drive current wherein valve-opening current is supplied when the logical product of the valve-opening current 24*a* and the holding current 24*b* is formed, and a relatively large holding current is supplied while the valve-opening signal 24*a* is ON after the current has reached the predetermined valve-opening current value, and predetermined holding current is supplied while the valve-opening signal 24*a* is OFF and the holding signal 24*b* is ON.

The above-mentioned fuel supply system comprises a means for detecting operating conditions, a means for calculating the width of the fuel injection pulse based on the operating condition, a means for supplying valve-opening current including predetermined large current to the solenoid located in the fuel injector based on the fuel injection pulse width, a means for supplying solenoid holding current for holding the valve-opening condition after the valve-opening current has reached the predetermined current value, a means for the fuel injection pulse width to consist of two signals: valve-opening signal and holding signal, a means for supplying valve-opening current to the solenoid located in the fuel injector only when the logical product of the valve-opening signal and the holding signal is formed, and a means for measuring time from the start of the fuel injection pulse; and the fuel supply system diagnoses an abnormality of the fuel injector's solenoid when the time period for valve-opening current to reach the predetermined large current value is shorter than the predetermined time.

A circuit configuration comprises battery voltage, a booster circuit for generating, from the battery voltage, larger voltage than the battery voltage, a switch (hereafter referred to as switch 1) for supplying current from the boosted voltage to the solenoid located in the fuel injector, a switch (hereafter referred to as switch 2) for supplying current from the battery voltage to the solenoid located in the fuel injector, a switch (hereafter referred to as switch 3) for sinking current from the solenoid located in the fuel injector toward the ground direction, and a flywheel circuit for supplying current to the solenoid located in the fuel injector, when the switch 1 and switch 2 are OFF, by directing current from ground via the solenoid located in the fuel injector and switch 3 and returns it to ground; wherein when an abnormality is detected in the solenoid, all three switches: switches 1, 2, and 3 are turned OFF.

Furthermore, the system further comprises a means for detecting current flowing through both switch 1 and switch 3, wherein the switch 1 and switch 3 are turned OFF when the logical product of the valve-opening signal and the holding signal is formed and when either current flowing through the switch 1 or switch 3 remains larger than the predetermined value for a duration that is longer than the predetermined time.

Moreover, the system further comprises a means for detecting current flowing through both switch 2 and switch 3, wherein the switch 2 and switch 3 are turned OFF when the valve-opening signal is OFF and the holding signal is ON and when either current flowing through the switch 2 or switch 3 remains larger than the predetermined value for a duration that is longer than the predetermined time.

The means is a means for protecting switches from being damaged by over-current, and the recovery timing from shutdown is the timing at which the next fuel injection starts.

Furthermore, if valve-opening current flowing through the solenoid located in the fuel injector has not reached the predetermined current value when the valve-opening signal is terminated, insufficient valve-opening current is detected. Also, if holding current larger than the predetermined current value does not flow through the solenoid located in the fuel injector when the holding signal is terminated, insufficient holding current is detected indicating that injector drive current is not sufficient.

Furthermore, a system comprises a constant voltage source, a constant current source, parallel connected to the switch 3, for supplying current from the constant voltage source, and a voltage detector for detecting voltage of the switch 3; and the system diagnoses an abnormality of the fuel injector's solenoid if voltage detected by the voltage detector is larger than the predetermined voltage when switch 1, switch 2, and switch 3 are all OFF; or a system comprises a constant voltage source, a constant current source, parallel connected to the switch 3, for supplying current from the constant voltage source, and a voltage detector for detecting voltage of the switch 3; and the system diagnoses an abnormality of the fuel injector's solenoid if voltage detected by the voltage detector is lower than the predetermined voltage when switch 1, switch 2, and switch 3 are all OFF; and as a result, the system detects that the switch 3 has been short-circuited to the battery or to ground.

To prevent misdiagnosis, the system also has a means that accepts the formation of the logical addition of the valve-opening signal and the holding signal only once while the holding signal is ON.

In the system, switch 1 and switch 2 are disposed for each opposed cylinder, and the system has a means for turning OFF the switch 3 which has been turned ON earlier when the ON timing of the opposed cylinder's switch 3 coincides; thereby masking the diagnosis which indicates insufficient holding current in the turned-off cylinder and preventing misdiagnosis.

Moreover, when the switch is shut down due to abnormal current, the system is capable of masking the diagnosis which indicates that valve-opening current and holding current are not sufficient, thereby preventing misdiagnosis.

The present invention also provides a diagnostic device that can diagnose the fuel supply system itself as well as protect the fuel supply system itself to prevent the system from being damaged when a failure occurs in the mode in which over-current flows though the fuel supply system.

In addition, to increase reliability of diagnosis, the system provides a means to determine each failure mode.

Reference signs show the following parts: 1 . . . engine, 2 . . . cylinder, 12 . . . fuel pump, 13 . . . injector, 14 . . . variable fuel pressure regulator, 15 . . . control unit, 16 . . . crank angle sensor, 17 . . . ignition coil, 21 . . . fuel pressure sensor, 24 . . . CPU, 32 . . . booster circuit, 33 . . . upstream switch element for valve-opening, 34 . . . upstream switch element for holding the valve, 35 . . . back-current prevention element, 36 . . . switch element for sink, 38 . . . reflux element, 39 . . . control section, 40 . . . reference current generating section, 41 . . . diagnostic section, 42 . . . SPI section.

The present invention provides a fuel supply system that can diagnose the fuel supply system itself as well as protect the fuel supply system itself.

What is claimed is:

1. A fuel supply system comprising:

means for detecting operating condition of an engine;

means for calculating the width of the fuel injection pulse based on the detected operating condition, the fuel injection pulse including valve-opening signal and holding signal;

means for supplying valve-opening current to the solenoid located in a fuel injector based on the fuel injection pulse width;

means for supplying solenoid holding current to hold the valve-opening condition after the valve-opening current has reached a predetermined current value;

wherein said fuel supply system supplies current to said solenoid when the logical product of said valve-opening signal and said holding signal has been formed; and wherein said fuel supply system diagnoses an abnormality of the fuel injector when the time period from the start of said fuel injection pulse until said valve-opening current reaches the predetermined current value is shorter than a predetermined time period.

2. A fuel supply system according to claim 1, further comprising:

battery voltage;

a booster circuit for generating voltage larger than the battery voltage from said battery voltage;

a first switch for supplying current from said booster circuit to said solenoid;

a second switch for supplying current from said battery voltage to said solenoid;

a third switch for sinking current from said solenoid toward the ground direction; and a flywheel circuit for supplying current to said solenoid, when said first switch and said second switch are OFF, by directing current from the ground through said solenoid located in the fuel injector and then through said third switch and returns it to the ground; and wherein said fuel supply system shut down said first switch through said third switch when an abnormality is determined in said solenoid.

3. A fuel supply system according to claim 2, wherein the recovery timing after said first switch, said second switch and said third switch have been shut down is the timing at which the next fuel injection starts.

4. A fuel supply system according to claim 2, further comprising:

means for detecting current flowing through each of said first switch and said third switch; and when the logical product of said valve-opening signal and said holding signal has been formed and when current flowing through either said first switch or said third switch remains larger than the predetermined value for a duration that is longer than the predetermined time, said fuel supply system shutting down either said first switch or said third switch.

5. A fuel supply system according to claim 4, wherein the recovery timing after said first switch and said third switch have been shut down is the timing at which the next fuel injection starts.

6. A fuel supply system according to claim 4, said fuel supply system stopping detecting insufficient valve-opening current during the fuel injection pulse when either said first switch or said third switch is shut down.

7. A fuel supply system according to claim 2, further comprising means for detecting current flowing through each of said second switch and said third switch; and when said valve-opening signal is OFF and said holding signal is ON and when current flowing through either said second switch or said third switch remains larger than the predetermined value for a duration that is longer than the predetermined time, said fuel supply system shutting down either said second switch or said third switch.

8. A fuel supply system according to claim 7, wherein the recovery timing after said first switch and said third switch have been shut down is the timing at which the next fuel injection starts.

9. A fuel supply system according to claim 7, wherein said fuel supply system stops detecting insufficient holding current during the fuel injection pulse when either said second switch or said third switch is shut down.

10. A fuel supply system according to claim 2, further comprising:

a constant voltage source, a constant current source, parallel connected to said third switch, for supplying current from said constant voltage source, and a voltage detector for detecting voltage of said third switch; and when said first switch through said third switch have been turned OFF and when voltage detected by said voltage detector is higher than the predetermined voltage, said fuel supply system diagnosing an abnormality of the fuel injector.

11. A fuel supply system according to claim 2, comprising:

a constant voltage source, a constant current source, parallel connected to said third switch, for supplying current from said constant voltage source, and a voltage detector for detecting voltage of said third switch; and when said first switch through said third switch have been turned OFF and when voltage detected by said voltage detector is lower than the predetermined voltage, said fuel supply system diagnosing an abnormality of the fuel injector.

12. A fuel supply system according to claim 2, wherein said first switch and said second switch are disposed for each opposed cylinder, and when the ON timing of the opposed cylinder's third switch coincides, the switch 3 which has been turned ON earlier is turned OFF.

13. A fuel supply system according to claim 12, wherein said fuel supply system stops detecting insufficient holding current during the fuel injection pulse when said third switch is shut down.

14. A fuel supply system according to claim 2, when any one of said first switch through said third switch is shut down and said valve-opening current flowing through said solenoid has not reached the predetermined current value when said valve-opening signal is terminated.

15. A fuel supply system according to claim 2, said fuel supply system stopping detecting insufficient holding current during the fuel injection pulse when said first switch through said third switch are shut down.

16. A fuel supply system according to claim 1, wherein said fuel supply system detects that holding current is insufficient when holding current more than the predetermined current value does not flow through said solenoid when said holding signal is terminated.

17. A fuel supply system comprising:

means for detecting operating condition of an engine;

means for calculating the width of the fuel injection pulse based on said detected operating condition, the fuel injection pulse including a valve-opening signal and a holding signal;

means for supplying valve-opening current to the solenoid located in the fuel injector based on the fuel injection pulse width, and means for supplying solenoid holding current for holding the valve-opening condition after said valve-opening current has reached the predetermined current value; and wherein said fuel supply system supplies current to said solenoid when the logical product of said valve-opening signal and said holding signal has been formed; and said fuel supply system detects that valve-opening current is insufficient when said valve-opening current flowing through said solenoid has not reached the predetermined current value when said valve-opening signal is terminated.

18. A fuel supply system comprising:

means for detecting operating condition of an engine;

means for calculating the width of the fuel injection pulse, consisting of two signals: valve-opening signal and holding signal, based on said detected operating condition;

means for supplying valve-opening current to the solenoid located in the fuel injector based on said fuel injection pulse width, and means for supplying solenoid holding current for holding the valve-opening condition after said valve-opening current has reached the predetermined current value; and said fuel supply system supplying current to said solenoid when the logical product of said valve-opening signal and said holding signal has been formed; and said fuel supply system diagnosing an abnormality of the fuel injector when the time period from the start of said fuel injection pulse until said valve-opening current reaches the predetermined current value is shorter than the predetermined; wherein the formation of the logical addition of said valve-opening signal and said holding signal is accepted only once each time when said holding signal is turned ON.

* * * * *